US012569108B2

(12) United States Patent
Marks et al.

(10) Patent No.: US 12,569,108 B2
(45) Date of Patent: Mar. 10, 2026

(54) DISHWASHER ASSEMBLY

(71) Applicant: Miele & Cie. KG, Guetersloh (DE)

(72) Inventors: Volker Marks, Bielefeld (DE); Benjamin Runau, Bielefeld (DE); Matthias Lampe, Petershagen (DE)

(73) Assignee: Miele & Cie. KG, Guetersloh (DE)

( * ) Notice: Subject to any disclaimer, the term of this patent is extended or adjusted under 35 U.S.C. 154(b) by 138 days.

(21) Appl. No.: 18/690,774

(22) PCT Filed: Sep. 8, 2022

(86) PCT No.: PCT/EP2022/074926
§ 371 (c)(1),
(2) Date: Mar. 11, 2024

(87) PCT Pub. No.: WO2023/046485
PCT Pub. Date: Mar. 30, 2023

(65) Prior Publication Data

US 2024/0389828 A1 Nov. 28, 2024

(30) Foreign Application Priority Data

Sep. 21, 2021 (BE) ..... 2021/5742

(51) Int. Cl.
*A47L 15/42* (2006.01)

(52) U.S. Cl.
CPC ..... *A47L 15/4293* (2013.01); *A47L 15/4246* (2013.01); *A47L 15/4261* (2013.01)

(58) Field of Classification Search
CPC ..... A47L 15/4261; A47L 15/4246; A47L 15/4293
See application file for complete search history.

(56) References Cited

U.S. PATENT DOCUMENTS 3,210,144 A * 10/1965 Ullman, Jr. ..... A47L 15/4257 134/182
6,719,383 B2 * 4/2004 Elick ..... A47L 15/4293 312/228
11,499,359 B2 11/2022 Koehler et al.
2003/0030288 A1 * 2/2003 Miller ..... E05B 63/248 292/303

(Continued)

FOREIGN PATENT DOCUMENTS

DE 102010044151 A1 * 5/2012 ..... G03B 21/005
DE 102019114740 A1 12/2020
EP 0541974 B1 11/1995

(Continued)

*Primary Examiner* — Benjamin L Osterhout
(74) *Attorney, Agent, or Firm* — Leydig, Voit & Mayer, Ltd.

(57) ABSTRACT

A dishwasher assembly includes: a dishwasher having a rinsing container that provides a rinsing chamber and receives washware to be cleaned, the rinsing container having a loading opening for loading the rinsing container with washware; a cover arranged over the dishwasher, the cover projecting beyond the rinsing container on a loading side thereof to form an overhang; and an operating device, which is arranged on an underside, facing the dishwasher, of the overhang, the operating device being connected for communication to a controller of the dishwasher, a dishwasher action being initiable by a user-actuation of the operating device.

20 Claims, 10 Drawing Sheets

(56) References Cited

U.S. PATENT DOCUMENTS

| | | | | |
|---|---|---|---|---|
| 2003/0127954 | A1* | 7/2003 | Elick | F24C 7/082 312/228 |

FOREIGN PATENT DOCUMENTS

| | | | | | |
|---|---|---|---|---|---|
| EP | 1151717 | A2 * | 11/2001 | | C08G 64/14 |
| EP | 1733675 | A2 * | 12/2006 | | A47L 15/4259 |
| EP | 3757337 | A1 | 12/2020 | | |
| GB | 2265158 | A * | 9/1993 | | D06F 34/05 |
| WO | WO 2014101937 | A1 | 7/2014 | | |

* cited by examiner

DISHWASHER ASSEMBLY

CROSS-REFERENCE TO PRIOR APPLICATIONS

This application is a U.S. National Phase application under 35 U.S.C. § 371 of International Application No. PCT/EP2022/074926, filed on Sep. 8, 2022, and claims benefit to Belgian Patent Application No. BE 2021/5742, filed on Sep. 21, 2021. The International Application was published in German on Mar. 30, 2023 as WO 2023/046485 A1 under PCT Article 21(2).

FIELD

The invention relates to a dishwasher assembly comprising a dishwasher, in particular a domestic dishwasher, and to a cover arranged over the dishwasher, wherein the dishwasher has a rinsing container that provides a rinsing chamber and is intended to receive washware to be cleaned, wherein the rinsing container comprises a loading opening for loading it with washware, and wherein the cover projects beyond the rinsing container on the loading side to form an overhang.

BACKGROUND

Dishwashers in general and in particular dishwasher assemblies in the form of a dishwasher having a cover arranged over the dishwasher are well known per se from the prior art, and therefore there is no need for separate published evidence at this point. For this reason, reference shall also be made only by way of example to DE 10 2019 114 740 A1, which discloses a dishwasher assembly of the type in question.

The dishwasher assembly according to the invention has, firstly, a dishwasher and, secondly, a cover arranged over the dishwasher. The cover can be part of a worktop of a row of kitchen units, as is also disclosed by DE 10 2019 114 740 A1, as already mentioned at the outset. However, the cover can also be a lid that is provided by the manufacturer of the dishwasher and is attached thereto ready for use. Such a lid already attached to the dishwasher by the manufacturer is used in particular in what are known as "stand-alone" appliances.

In addition, dishwashers of the type mentioned at the outset have a rinsing container, which provides a rinsing chamber, in a manner known per se. When used as intended, the rinsing chamber is intended to receive washware to be cleaned. To allow the user to load the rinsing container with washware, the rinsing container has a loading opening. Said loading opening can be closed in a fluid-tight manner by means of a pivotally mounted rinsing chamber door.

To ensure that the cover arranged over the dishwasher covers not only the rinsing container but also the end face of the rinsing chamber door when the rinsing chamber door is covered, the cover projects beyond the rinsing container on the loading side to form an overhang. In the depth direction of the dishwasher, this overhang has at least one dimension that corresponds to the end-face thickness of the rinsing chamber door. However, the overhang can also be designed to be larger, as is typically the case with a cover used as a worktop.

Dishwasher assemblies of the type described above have proven themselves in everyday practical use. However, there is a need for improvement.

SUMMARY

In an embodiment, the present invention provides a dishwasher assembly, comprising: a dishwasher having a rinsing container that provides a rinsing chamber and being configured to receive washware to be cleaned, the rinsing container having a loading opening for loading the rinsing container with washware; a cover arranged over the dishwasher, the cover projecting beyond the rinsing container on a loading side thereof to form an overhang; and an operating device, which is arranged on an underside, facing the dishwasher, of the overhang, the operating device being connected for communication to a controller of the dishwasher, a dishwasher action being initiable by a user actuation of the operating device.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
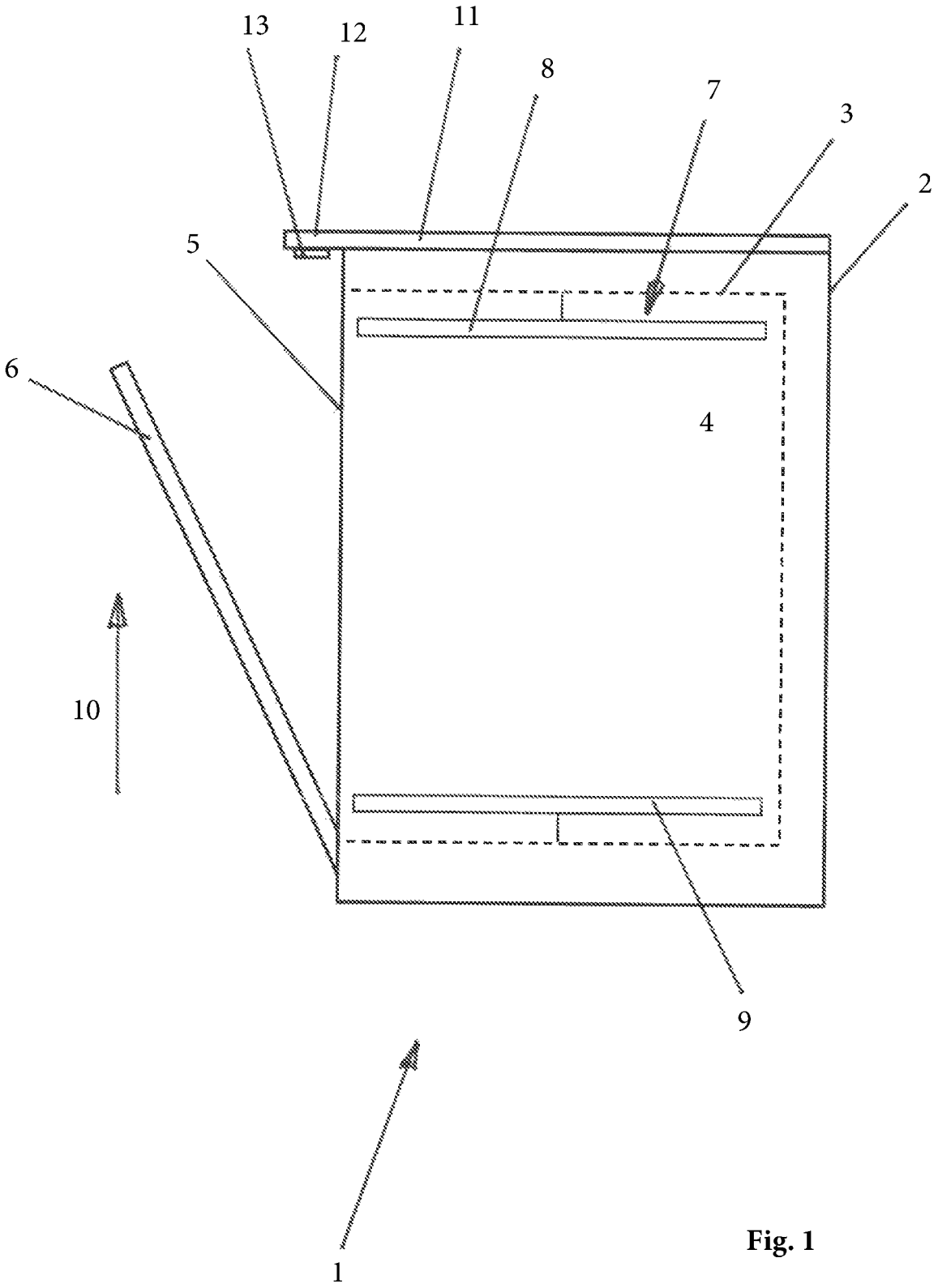
FIG. 1 is a schematic view of a dishwasher according to the invention.

In an embodiment, the present invention provides a dishwasher assembly that is simplified and thus provides optimized handling for a user. In an embodiment, the invention provides a dishwasher assembly of the type mentioned at the outset that is structurally developed to allow simplified handling by a user.

In an embodiment, the invention provides a dishwasher assembly of the type mentioned at the outset, which is characterized by an operating device, which is arranged on the underside, facing the dishwasher, of the overhang and is connected for communication to a controller of the dishwasher, wherein a dishwasher action can be initiated by means of a user-actuation of the operating device.

The dishwasher assembly according to the invention has an operating device. Said operating device is used by the user to operate the dishwasher. A dishwasher action can be initiated by means of a user-actuation of the operating device. Such an action can be, for example, automatically closing the rinsing chamber door, starting a rinsing program and/or switching on lights.

The inventive feature is that the operating device is not designed as part of the dishwasher, but is arranged on the underside, facing the dishwasher, of the overhang. The operating device is connected for communication to a controller of the dishwasher.

Dishwashers of the typical design have an operating unit, which is provided by the rinsing chamber door. Such operating units can be designed, for example, to be on the front of a rinsing chamber door or, in particular in the case of a dishwasher fully integrated into a row of kitchen units, on the end face of the rinsing chamber door. In the case of a rinsing chamber door that is open, the accessibility of operating units positioned in such a way is not provided or only insufficiently provided. In any case, a user either needs to bend down in the direction of the operating unit or initially at least partially close the rinsing chamber door in order to reach the operating unit provided by the rinsing chamber door.

The invention now proposes the provision of an operating device in addition to the operating unit of the dishwasher, i.e., a second operating device. However, said second operating device is not installed on the dishwasher but is arranged on the underside, facing the dishwasher, of the overhang of the cover. This additional operating device provided according to the invention can be actuated in a simple manner by a user when the rinsing chamber door is open without the need to bend down or kneel or at least partially close the rinsing chamber door. This results in a considerable simplification for the user when actuating the dishwasher as intended.

The operating device provided according to the invention is connected for communication to a controller of the dishwasher. In principle, it is thereby possible to initiate all actions that can be controlled by the controller of the dishwasher by means actuating this operating device. In this context, however, only those actions whose actuation is expedient in a rinsing chamber door located in the open position are in particular offered.

An action that is expedient in this sense is switching on rinsing chamber lights. Typically, the rinsing chamber lights are switched on automatically when the rinsing chamber door is transferred into an open position. However, the lighting device remains activated only for a predeterminable period of time and is automatically switched off after this predeterminable period of time has elapsed, even when the rinsing chamber door is still in an open position. The user can now switch on the lighting device again, namely using the operating device provided according to the invention. In this respect, it is advantageously not necessary to have to close the rinsing chamber door and open it again or to reach the operating unit provided by the rinsing chamber door. This results in significantly simplified handling.

Another expedient action according to the invention is a motor-driven door closure. This is typically done starting from a rinsing chamber door in an open position. In this case too, the operating device provided according to the invention can be reached by a user in a simple manner on account of its arrangement on the underside, facing the dishwasher, of the overhang, which does not require gripping the rinsing chamber door or operating an operating unit provided by the rinsing chamber door.

As a result, the invention proposes an operating device, which is designed to be outside the dishwasher and by means of which, on account of being connected for communication to the controller of the dishwasher, a dishwasher action can be initiated in the event of a user actuation. In this case, the operating device is arranged on the underside, facing the dishwasher, of the overhang of a cover, which allows it to be simply and easily reached by a user, in particular because he does not have to bend down or kneel, as is the case for reaching an operating unit provided by the rinsing chamber door.

According to a further feature of the invention, it is provided that the dishwasher has a motor device for the motor-driven transfer of a rinsing chamber door from an open position into a closed position closing the loading opening, wherein automatic transfer of the rinsing chamber door into the closed position can be initiated by means of a user-actuation of the operating device.

According to this alternative of the invention, in a manner known per se the dishwasher has a motor device, which, when used as intended, is used to close the rinsing chamber door by means of an electric motor, i.e., to be able to move it from an open position to a closed position closing the loading opening. According to the invention, it is provided that activation of the motor device can be initiated by means of a user-actuation of the operating device. Because the operating device is arranged according to the invention on the underside, facing the dishwasher, of the overhang of the cover in the manner already described above, a user is able, when used as intended, to easily reach the operating device, even though the rinsing chamber door is open. In contrast to the prior art, it is therefore not necessary to actuate an operating panel provided on the rinsing chamber door or an operating unit provided by the rinsing chamber door.

According to a further feature of the invention, it is provided that the operating device has a plurality of operating elements arranged one behind the other in the transverse direction of the dishwasher.

According to the invention, it is therefore provided that the operating device not only provides a single operating element, but has a plurality of operating elements which, in the event of an actuation, each serve to initiate a dishwasher action. In this case, the operating elements are arranged in a space-saving manner, namely one behind the other in the transverse direction of the dishwasher.

According to a first alternative of the invention, the operating elements can be used to initiate different actions in each case. Depending on the action to be initiated, the user must therefore actuate the appropriate operating element.

According to a second and preferred alternative embodiment, it is provided that the operating elements are all intended to initiate the same action when operated by a user. A plurality of operating elements are thus provided, wherein the intended actuation of an operating element results in the initiation of the same action independently of the actuated operating element. This embodiment has the advantage that a user can grasp the operating device and actuate one of the operating elements provided thereon, and therefore does not have to choose between different operating elements. This allows for accurate and intuitive operation, in particular when the operating device is in any case only provided for initiating an action in the event of an actuation, for example automatic rinsing chamber door closure. Furthermore, this embodiment has the advantage that it can be operated equally well by left-handed and right-handed people.

According to a third alternative, it can also be provided that a plurality of operating elements are provided, which are combined into groups, wherein the operating elements of a group are all used to be able to initiate the same action in the event of an actuation. In contrast, operating elements in different groups are used to initiate different dishwasher actions. In this context, it can thus be provided, for example, that the operating device has two groups of operating elements, wherein a plurality of operating elements are provided per group and are arranged one behind the other in the transverse direction of the dishwasher.

According to a further feature of the invention, it is provided that an operating element is a switch or a sensor.

In particular, toggle or pushbutton switches can be used as switches. These can, for example, be mechanical and initiate the corresponding action in a manner known per se in the event of an actuation. Alternatively, an operating element is designed as a sensor, for example as a light-sensitive sensor that is designed to be able to detect a user movement or cover. Should something be detected, the dishwasher action is then initiated via the controller of the dishwasher in the manner already described above.

According to a further feature of the invention, it is provided that the operating device is designed to be electrically and/or electromechanically sensitive. The operating device can thus be, for example, in the form of a touchpad or touchscreen or in a form similar or comparable to a touchpad or touchscreen. This embodiment has the advantage that it is not necessary for the user to actuate a previously selected operating element. Rather, this embodiment makes it possible for the operating device to be sensitive across the entire width of the dishwasher, allowing the user to contact or actuate any point of the operating device to initiate an action. Simplified operation is also achieved as a result because the user simply only needs to touch any point of the operating device to initiate the desired action. In this case, it can also be provided to divide the operating device into different zones, wherein the zones are used to initiate different actions in the event of an actuation. For example, the operating device can be divided in two, creating a left-hand zone on one side and a right-hand zone on the other when looking in the direction of the dishwasher.

According to a further feature of the invention, it is provided that the operating device extends in the transverse direction of the dishwasher over more than one third, preferably over more than half, even more preferably over more than two thirds of the width of the dishwasher.

To additionally support simple operation by means of the operating device according to the invention, it is preferred to design the operating device to be as wide as possible in the transverse direction of the dishwasher. This promotes easy access, in particular also from the side when the rinsing chamber door is open. For this reason, the invention proposes that the operating device extends over more than one third of the width of the dishwasher in the transverse direction of the dishwasher. In this case, the operating device can preferably be provided either on the left side or on the right side of the dishwasher when looking at the dishwasher. A central arrangement with respect to the transverse direction of the dishwasher is preferred if the operating device extends in the transverse direction of the dishwasher preferably over more than half of the width of the dishwasher.

However, for easy access to the operating device, it is preferred if the operating device extends over the entire width of the dishwasher.

According to a further feature of the invention, it is provided that the position of the operating device and/or the operating elements on the underside of the overhang of the cover can be freely selected by the user.

Because the operating device provided according to the invention is not fixedly connected to the dishwasher by the manufacturer as a quasi-second operating device, the arrangement of the operating device on the underside, facing the dishwasher, of the overhang of the cover can advantageously be freely selected. This freedom of selection is advantageous in particular when the operating device does not extend over the entire width of the dishwasher. In this case, a user can freely select whether the operating device is to be positioned more to the left or more to the right when looking at the dishwasher. In this way, individual user-based specifications can be taken into account.

According to a further feature of the invention, the operating device is integrated in a water vapor protection element.

When a dishwasher is opened by the user during operation, i.e., the rinsing chamber door is transferred from its closed position into an open position, water vapors in the rinsing container escape and rise. Water vapor also escapes in this way in the event of automatic door opening at the end of a completed rinsing program.

The water vapors escaping from a dishwasher precipitate on the underside of a cover arranged over the dishwasher, where they condense out. In order to protect the cover from damage by condensation, in particular when used as a worktop, it is known per se from the prior art to provide the worktop underside with what is known as a water vapor protection element. This water vapor protection element serves as a condensation surface for water vapors escaping from the dishwasher, whereby the worktop underside is kept free of vapor in the region of the water vapor protection element and is thus protected.

A particularly preferred alternative of the invention now proposes that the operating device according to the invention is integrated into such a water vapor protection element.

A water vapor protection element equipped in such a way thus serves two functions. Firstly, in a manner known per se, it serves to protect the underside of the cover from condensation of water vapors. Secondly, the operating device according to the invention is provided with the water vapor protection element, which simplifies operation of the dishwasher in the manner already described above. A synergistic advantage of the invention is therefore that a water vapor protection element, which is preferably to be provided in any case, also allows the dishwasher to be operated.

According to a further feature of the invention, it is provided that the water vapor protection element is a strip element made of plastics, which strip element is provided with an adhesive layer on its large side facing the cover in the final assembled state and provides the operating device on its large side facing away from the cover in the final assembled state.

According to this alternative embodiment, the operating device is attached to the side of the water vapor protection element facing the dishwasher. This makes it possible to use water vapor protection elements known per se from the prior art, namely in combination with an operating device according to the invention. The water vapor protection element and the operating device can preferably be pre-assembled and then assembled on site as a quasi-integral component. For this purpose, the water vapor protection element has a large side facing the underside of the overhang in the final assembled state, which large side is provided with an adhesive layer. A simple and position-variable arrangement of the combination of the water vapor protection element and the operating device on the cover covering the upper side of the dishwasher is thus made possible.

According to an alternative embodiment of the invention, it is provided that the water vapor protection element is a strip element made of plastics, which strip element is provided with an adhesive layer on its large side facing the cover in the final assembled state, wherein the operating device is embedded in the plastics material of the strip element.

The advantage of this embodiment is that the operating device is additionally protected by the water vapor protection element, in particular against unwanted external influences. Because the operating device is embedded in the plastics material of the strip element, the result is an essentially integral component that can be easily assembled on site, wherein in this case the water vapor protection element serves not only to protect the cover but also to protect the operating device.

In a manner that may subject it to protection in itself, the invention also proposes a water vapor protection element for arrangement on the underside of a cover arranged over a domestic appliance, in particular a dishwasher, having a strip element made of plastics, which strip element is provided with an adhesive layer on its large side facing the cover in the final assembled state, characterized by an operating device, which is connected for communication to a controller of the domestic appliance, wherein a domestic appliance action can be initiated by means of a user-actuation of the operating device.

As already explained above, substantially two advantages are achieved with such a water vapor protection element. Firstly, the underside of the cover is protected from damage by condensing water vapors. Secondly, the provision of an operating device makes it possible for the user to be able to operate the dishwasher in a simplified manner, in particular when the rinsing chamber door is open. In this respect, the advantages already explained above are associated with the water vapor protection element according to the invention.

According to a first alternative embodiment, the water vapor protection element according to the invention can have an operating device that is arranged on the large side of the strip element facing away from the cover in the final assembled state. Alternatively, the operating device is embedded in the plastics material of the strip element.

These two alternative embodiments offer the advantages already described above.

FIG. 1 is a purely schematic view of a dishwasher 1 according to the invention.

The dishwasher 1 has, in a manner known per se, a housing 2, which accommodates a rinsing container 3. The rinsing container 3 in turn provides a rinsing chamber 4 for accommodating washware to be cleaned. To load the rinsing chamber 4 with washware to be cleaned, the rinsing container 3 has a loading opening 5. This can be closed in a fluid-tight manner by means of a rinsing chamber door 6, wherein the rinsing chamber door 6 is mounted so as to be pivotable about a horizontally extending pivot axis.

When used as intended, rinsing liquid, known as rinsing liquor, is applied to the washware to be cleaned, for which purpose the dishwasher 1 has a spray device 7. In the embodiment shown, an upper spray arm 8 and a lower spray arm 9 form part of the spray device 7 and are each arranged so as to be rotatably mounted.

A cover 11 is provided over the dishwasher 1 In the vertical direction 10. The cover 11 can be part of a worktop of a row of kitchen units or a lid already assembled by the manufacturer. In any case, the cover 11 projects beyond the rinsing container 3 on the loading side to form an overhang 12. In terms of design, the overhang 12 is necessary to ensure that the rinsing chamber door 6 is covered on the end face in the closed position.

According to the invention, an operating device 13 is provided, which is arranged on the underside 16 of the overhang 12 facing the dishwasher 1.

Figure 2:
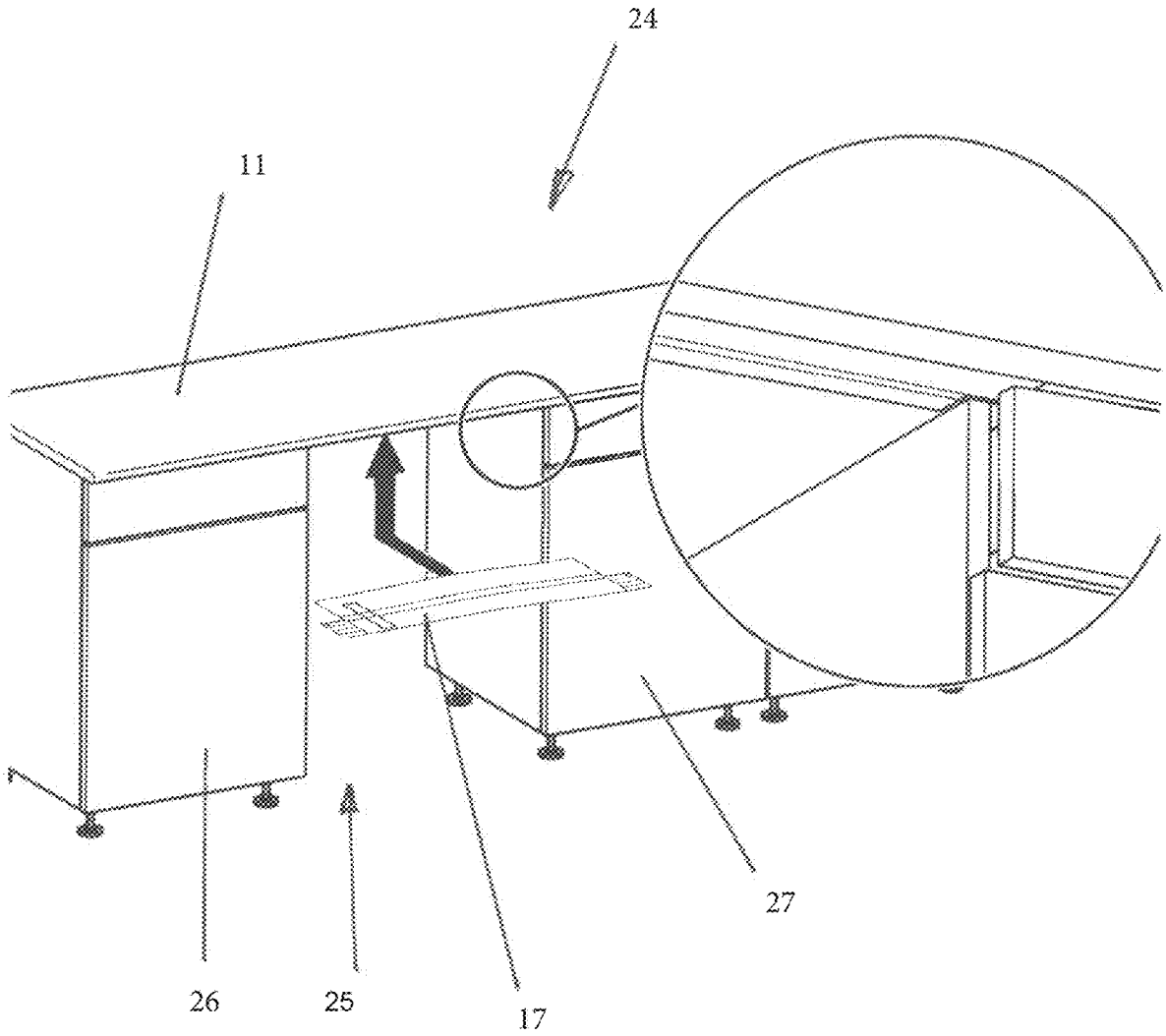
FIG. 2 is a schematic perspective view of a row of kitchen units.

FIG. 2 is a schematic perspective view of a row of kitchen units 24. The row of kitchen units 24 has kitchen cabinets 26 and 27 that are arranged at a distance from one another, leaving a niche 25. On the upper side, the kitchen cabinets 26 and 27 and the niche 25 are covered by a worktop serving as a cover.

The niche 25 of the row of kitchen units 24 serves to accommodate a dishwasher 1 (not shown in detail in FIG. 2).

For protection against water vapors escaping from a dishwasher 1, the underside of the worktop is provided with a water vapor protection element 17 in the region of the niche 25, as can be seen from the arrow representation according to FIG. 2. According to the invention, an operating device 13 is integrated into the water vapor protection element 17, as can be seen in particular from a combination of FIGS. 3 to 5.

The water vapor protection element 17 is a strip element 18 made of plastics. It is provided with an adhesive layer on its large side 19 (cf. FIG. 6) facing the cover 11 in the final assembled state. In the final assembled state, the water vapor protection element 17 is adhered to the underside 16 of the cover 11, as shown in FIG. 3.

On its large side 20 facing away from the cover 11 in the final assembled state, the water vapor protection element 17 is provided with an operating device 13 according to the invention. A connection cable 23 is provided for connecting the operating device 13 and a controller of the dishwasher 1 for communication.

Figure 3:
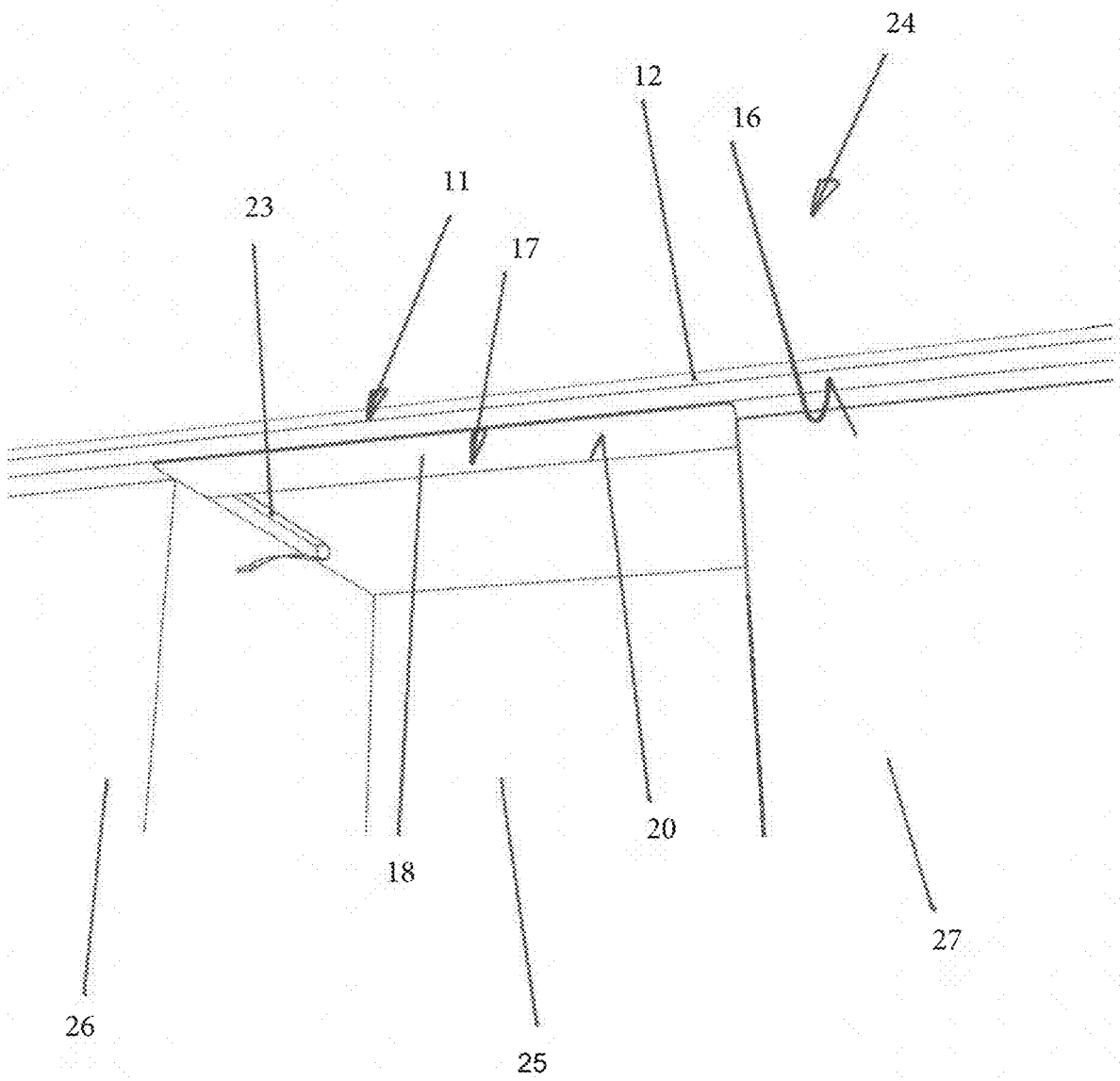
FIG. 3 is a schematic perspective view from below of the niche in a row of kitchen units for receiving a dishwasher.
Figure 4:
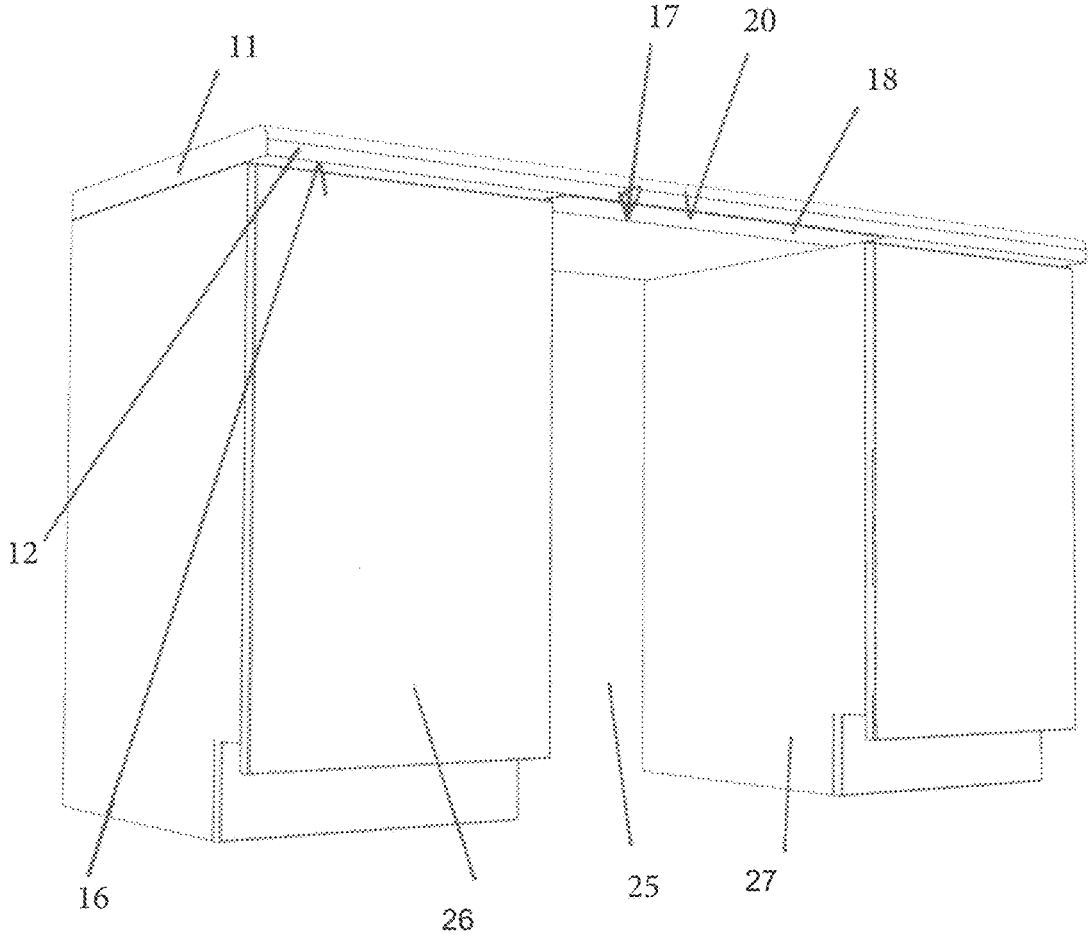
FIG. 4 is a schematic perspective view of a row of kitchen units with a niche for receiving a dishwasher.
Figure 5:
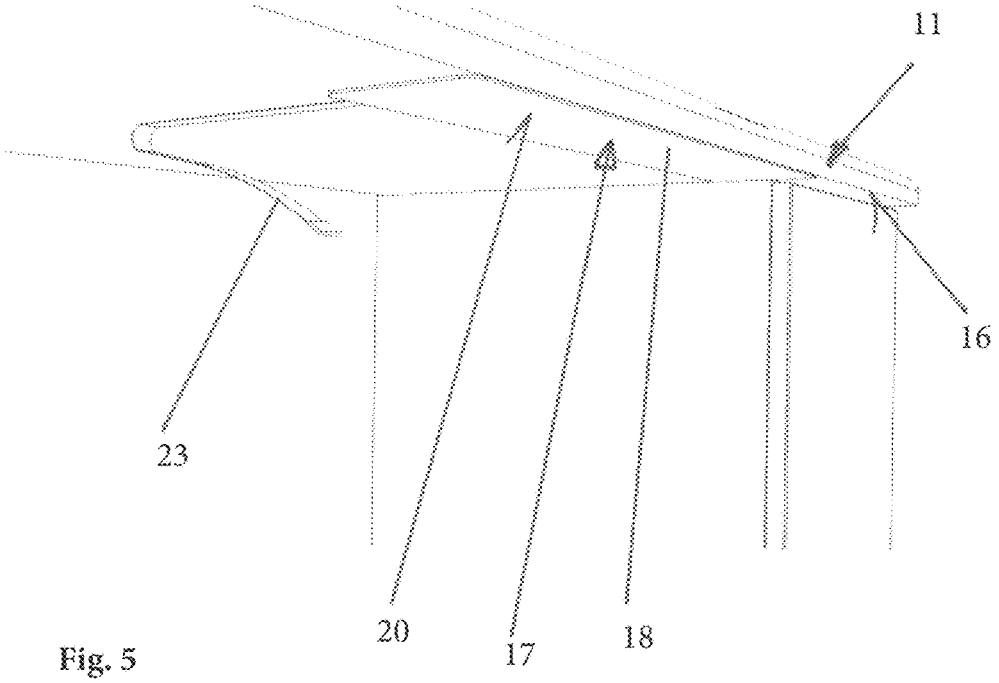
FIG. 5 is a schematic perspective detailed view of the niche according to FIG. 4.
Figure 6:
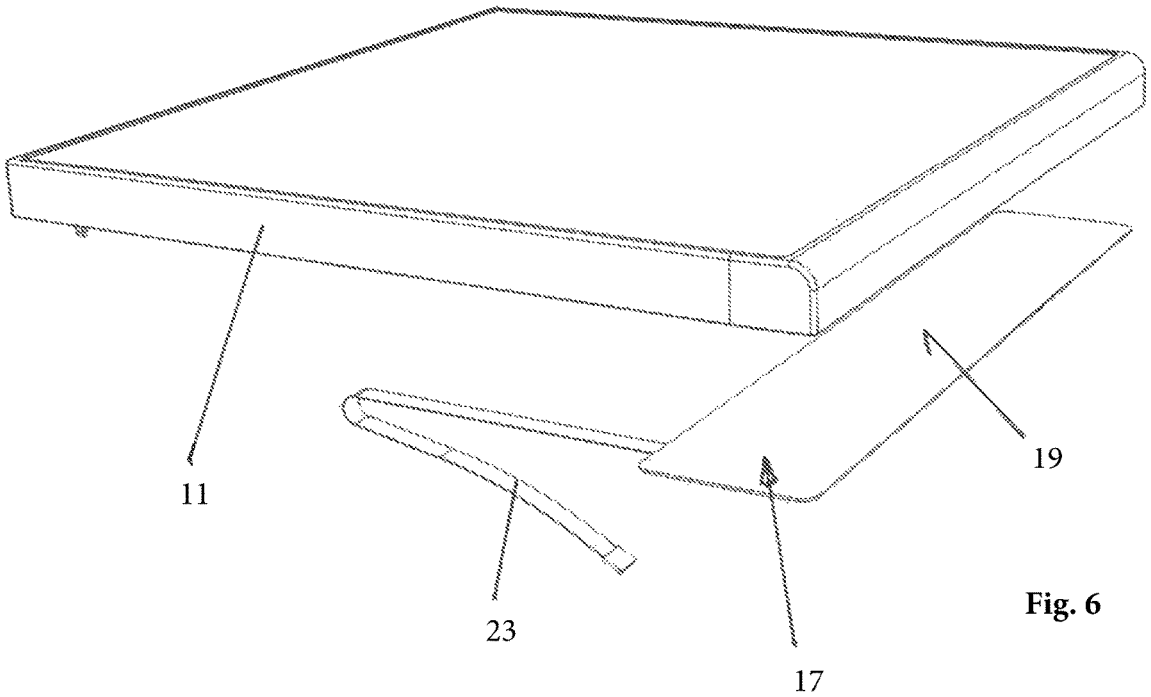
FIG. 6 is a schematic perspective view of a lid of a dishwasher that serves as a cover and has an operating device that is not yet assembled.
Figure 7:
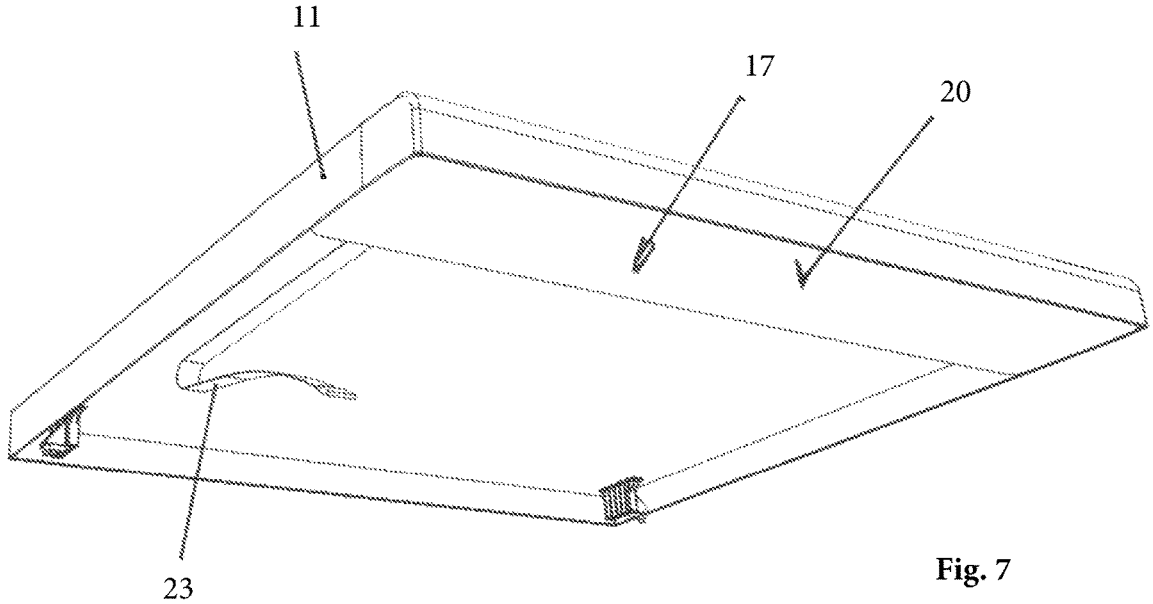
FIG. 7 is a schematic perspective view of the lid according to FIG. 6 with the operating device assembled.
Figure 8:
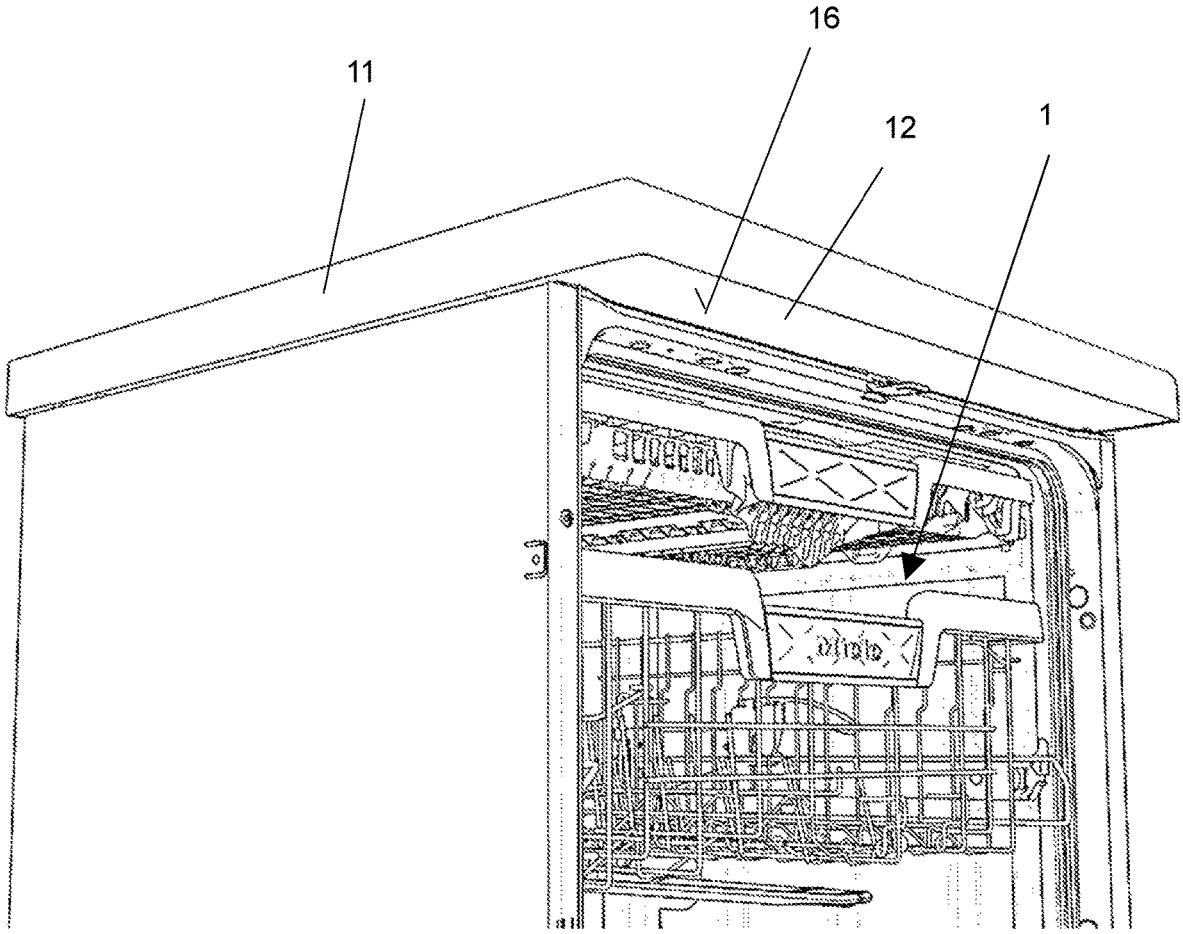
FIG. 8 is a schematic perspective view of the lid according to FIGS. 6 and 7 assembled on a dishwasher.
Figure 9:
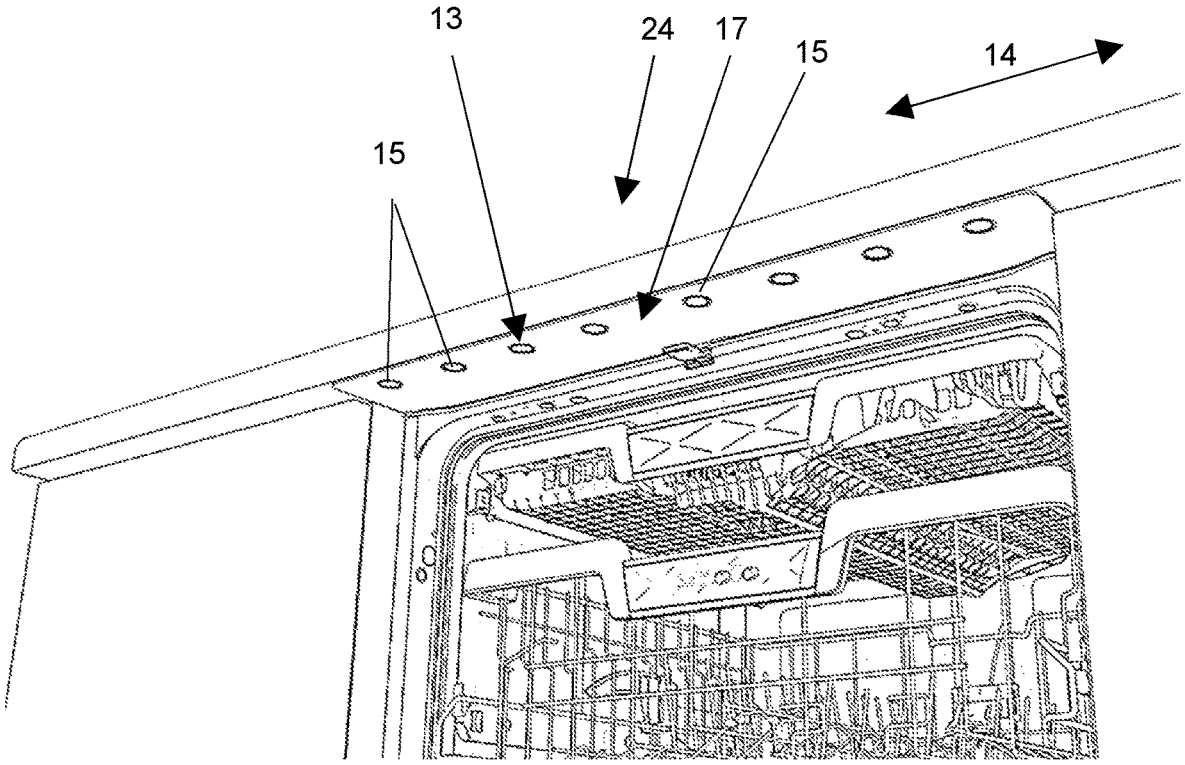
FIG. 9 is a schematic perspective view of a worktop provided with an operating device according to the invention.
Figure 10:
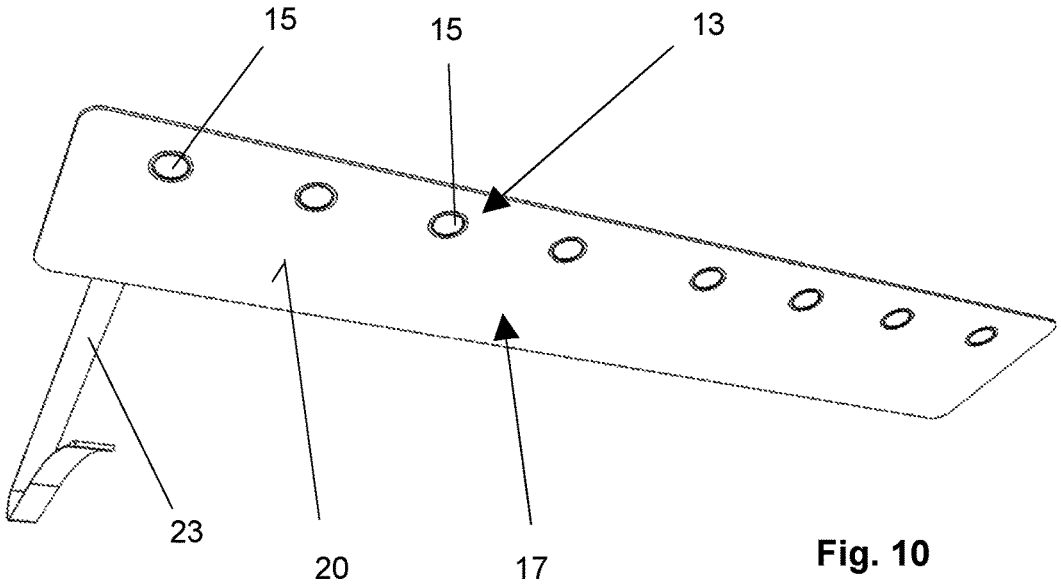
FIG. 10 is a schematic perspective view of the operating device according to FIG. 9.
Figure 11:
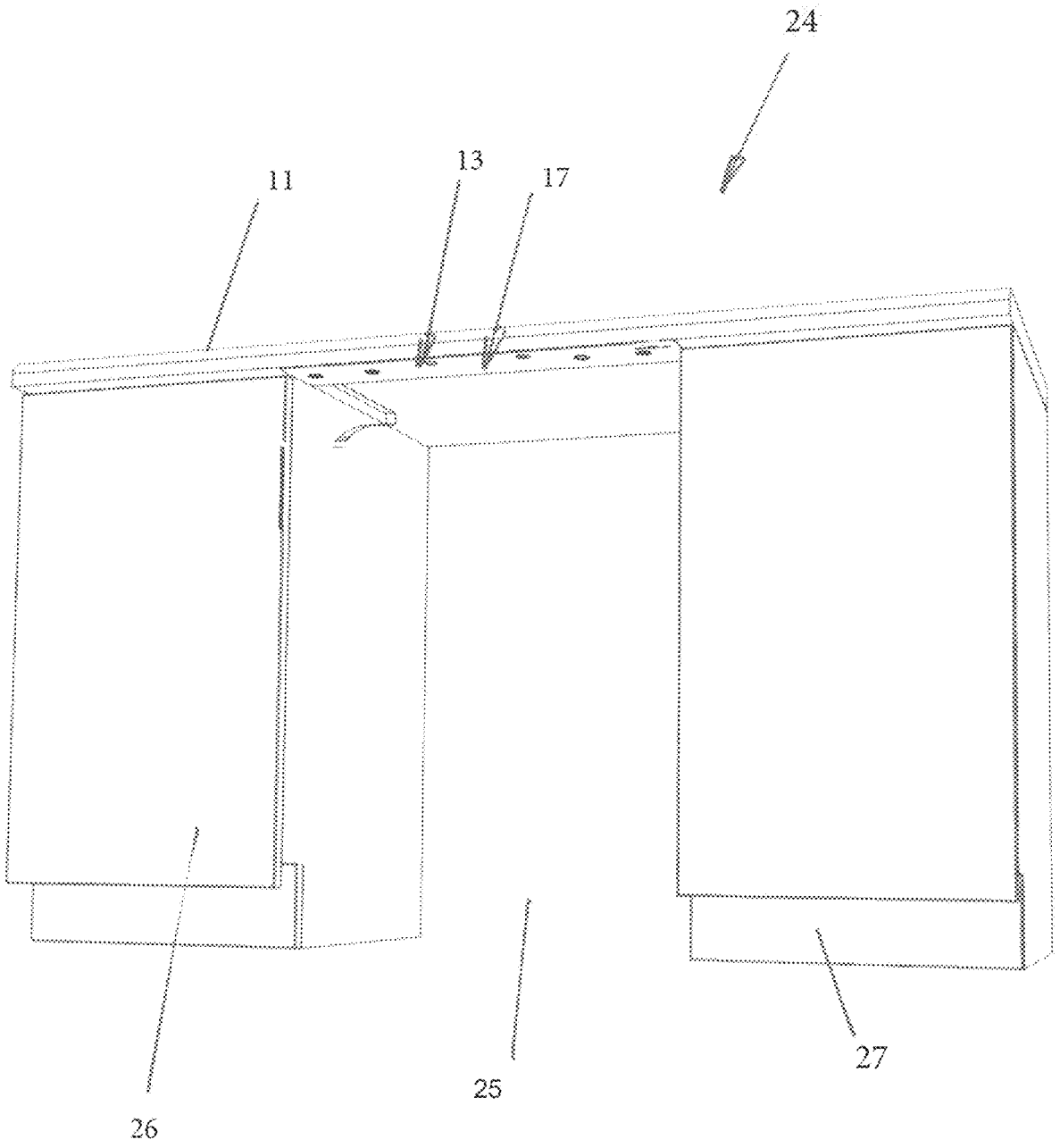
FIG. 11 is a schematic perspective view of the operating device according to FIG. 10, arranged in a niche of a row of kitchen units.
Figure 12:
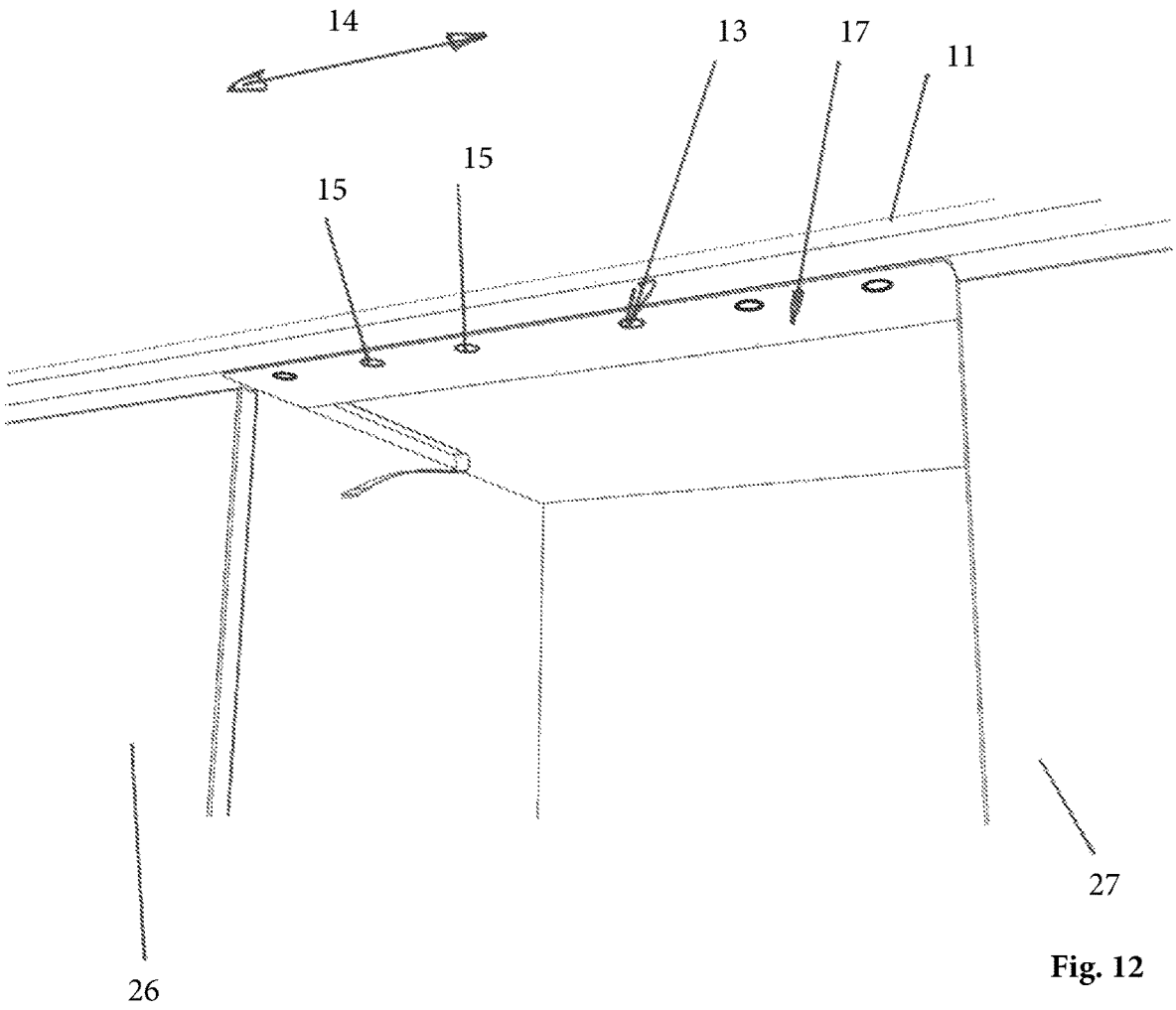
FIG. 12 is a perspective detailed view of the niche according to FIG. 11.

The embodiment according to FIGS. 3 to 5 relates to the embodiment of a cover 11 as part of a worktop of a row of kitchen units 24. The embodiment according to FIGS. 6 to 8 shows a lid that is pre-assembled as a cover 11 by the manufacturer and is attached to the dishwasher 1. In this case, the water vapor protection element 17 together with the integrated operating device 13 can be designed in the same way as when used in conjunction with a worktop.

An embodiment of the operating device 13 according to the invention is shown in FIGS. 9 to 12, according to which the operating device 13 has a plurality of operating elements 15. The operating elements 15 are arranged one behind the other in the transverse direction 14 of the dishwasher 1. According to the embodiment shown, the operating device 13 is designed, for example, as a membrane keyboard or as a silicone switching mat. In this case, it is preferred for all operating elements 15 to be used to initiate the same action, which has the advantage of achieving simplified operation by the user because he does not have to actuate a specific operating element 15, but only one of the many operating elements 15 provided.

As an alternative to the embodiment of the operating elements 15, it can be provided that the operating device 13 is designed to be electrically and/or electromechanically sensitive. This embodiment has the advantage that the user can touch or contact the operating device 13 anywhere to operate it as intended. In this context, it is particularly preferred if the operating device 13 extends in the transverse direction 14 over the entire width of the dishwasher 1.

Figure 13:
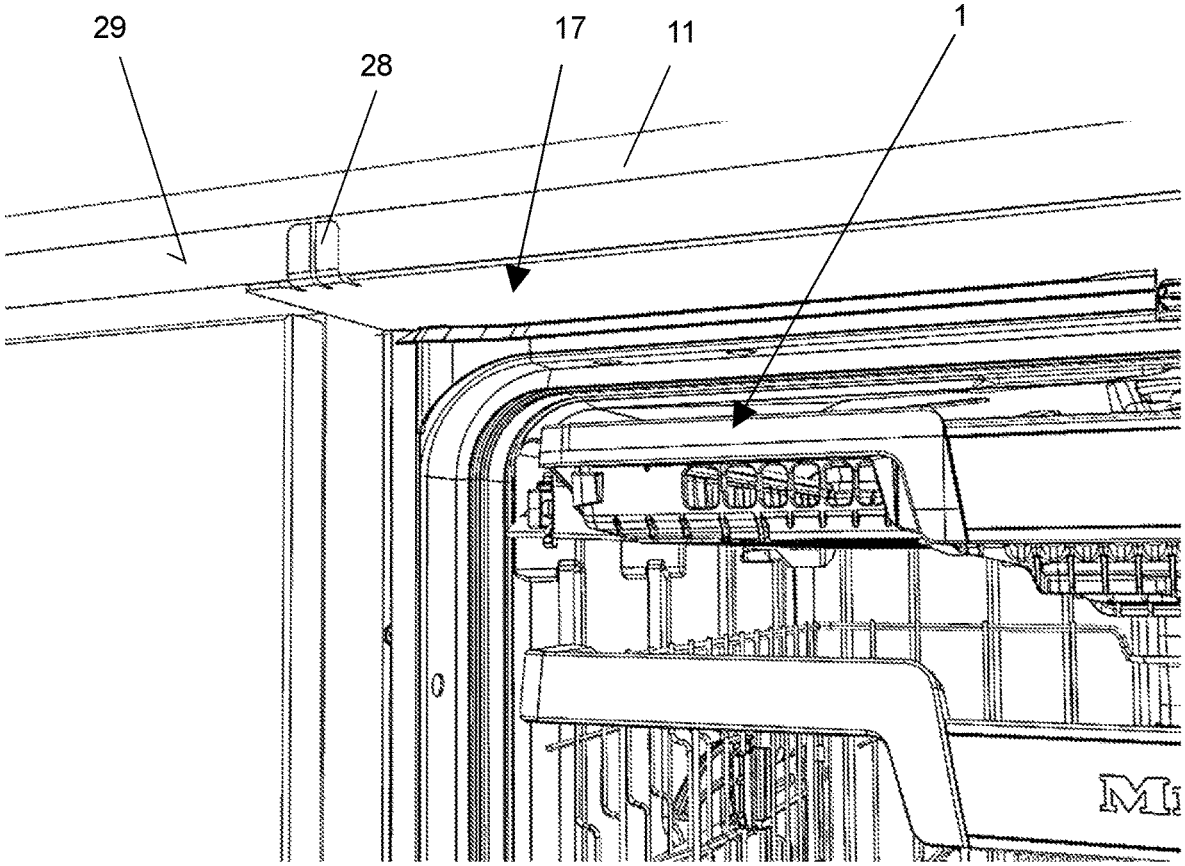
FIG. 13 is a schematic perspective view of an operating device in a further embodiment.
Figure 14:
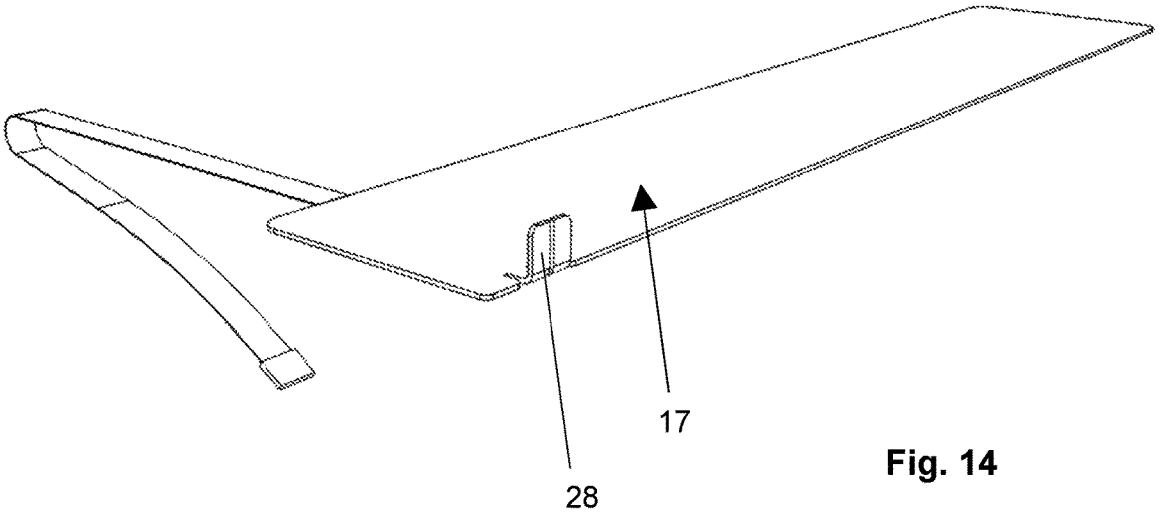
FIG. 14 is a schematic perspective representation of the operating device according to FIG. 13.

FIGS. 13 and 14 show a further embodiment. Accordingly, it is provided that the operating device 13 integrated into a water vapor protection element 17 has a further actuation element 28, which, in the final assembled state, comes to rest on the end face 29 of the cover 11. This allows frontal operation by the user, with the additional advantage that the actuation element 28 can be seen by the user when looking at the dishwasher 1 and that actuation is also possible when the rinsing chamber door 6 is closed.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SIGNS

1 Dishwasher
2 Housing
3 Rinsing container
4 Rinsing chamber
5 Loading opening
6 Rinsing chamber door
7 Spray device
8 Spray arm
9 Spray arm
10 Vertical direction
11 Cover
12 Overhang
13 Operating device
14 Transverse direction
15 Operating element
16 Underside
17 Water vapor protection element
18 Strip element
19 Large side
20 Large side
23 Connection cable
24 Row of kitchen units
25 Niche
26 Kitchen cabinet
27 Kitchen cabinet
28 Actuation element
29 End face

The invention claimed is:

1. A dishwasher assembly, comprising:

a dishwasher having a rinsing container that provides a rinsing chamber and being configured to receive washware to be cleaned, the rinsing container having a loading opening for loading the rinsing container with washware;

a cover arranged over the dishwasher, the cover projecting beyond the rinsing container on a loading side thereof to form an overhang; and an operating device, which is arranged on an underside, facing the dishwasher, of the overhang, the operating device being connected for communication to a controller of the dishwasher, a dishwasher action being initiable by a user actuation of the operating device, wherein the operating device has a plurality of operating elements arranged one behind another in a transverse direction of the dishwasher, and wherein the plurality of operating elements are all configured to initiate a same action based on the user actuation.

2. The dishwasher assembly of claim 1, further comprising:

a motor device for motor-driven transfer of a rinsing chamber door from an open position into a closed position closing the loading opening, wherein the user actuation of the operating device is adapted to initiate automatic transfer of the rinsing chamber door into the closed position.

3. The dishwasher assembly of claim 1, wherein one operating element of the plurality of operating elements comprises a switch or a sensor.

4. The dishwasher assembly of claim 1, wherein the operating device is electrically and/or electromechanically sensitive.

5. The dishwasher assembly of claim 1, wherein the operating device extends in a transverse direction of the dishwasher over more than one third of a width of the dishwasher.

6. The dishwasher assembly of claim 5, wherein the operating device extends over an entirety of the width of the dishwasher.

7. The dishwasher assembly of claim 1, wherein the operating elements and/or the operating device are positionable on the underside of the overhang so as to be freely selectable by the user.

8. The dishwasher assembly of claim 1, further comprising:

a water vapor protection element arranged on the underside of the overhang, the operating device being integrated into the water vapor protection element.

9. The dishwasher assembly of claim 8, wherein the water vapor protection element comprises a strip element comprising plastics, which strip element is provided with an adhesive layer on a side thereof facing the cover in a final assembled state of the dishwasher assembly and carries the operating device on a side facing away from the cover in the final assembled state.

10. The dishwasher assembly of claim 8, wherein the water vapor protection element comprises a strip element comprising plastics, the operating device being embedded in a plastics material of the strip element.

11. The dishwasher assembly of claim 1, wherein the dishwasher comprises a domestic dishwasher.

12. The dishwasher assembly of claim 5, wherein the operating device extends in the transverse direction of the dishwasher over more than half of the width of the dishwasher.

13. The dishwasher assembly of claim 12, wherein the operating device extends in the transverse direction of the dishwasher over more than two thirds of the width of the dishwasher.

14. A dishwasher assembly, comprising:

a dishwasher having a rinsing container that provides a rinsing chamber and being configured to receive washware to be cleaned, the rinsing container having a loading opening for loading the rinsing container with washware;

a cover arranged over the dishwasher, the cover projecting beyond the rinsing container on a loading side thereof to form an overhang; and an operating device, which is arranged on an underside, facing the dishwasher, of the overhang, the operating device being connected for communication to a controller of the dishwasher, a dishwasher action being initiable by a user actuation of the operating device, wherein the operating device extends in a transverse direction of the dishwasher over more than one third of a width of the dishwasher.

15. The dishwasher assembly of claim 14, wherein the operating device extends in the transverse direction of the dishwasher over more than half of the width of the dishwasher.

16. The dishwasher assembly of claim 14, wherein the operating device extends in the transverse direction of the dishwasher over more than two thirds of the width of the dishwasher.

17. The dishwasher assembly of claim 16, wherein the operating device extends in the transverse direction of the dishwasher over more than two thirds of the width of the dishwasher.

18. A dishwasher assembly, comprising:

a dishwasher having a rinsing container that provides a rinsing chamber and being configured to receive washware to be cleaned, the rinsing container having a loading opening for loading the rinsing container with washware;

a cover arranged over the dishwasher, the cover projecting beyond the rinsing container on a loading side thereof to form an overhang;

an operating device, which is arranged on an underside, facing the dishwasher, of the overhang, the operating device being connected for communication to a controller of the dishwasher, a dishwasher action being initiable by a user actuation of the operating device; and a water vapor protection element arranged on the underside of the overhang, the operating device being integrated into the water vapor protection element.

19. The dishwasher assembly of claim 18, wherein the water vapor protection element comprises a strip element comprising plastics, which strip element is provided with an adhesive layer on a side thereof facing the cover in a final assembled state of the dishwasher assembly and carries the operating device on a side facing away from the cover in the final assembled state.

20. The dishwasher assembly of claim 18, wherein the water vapor protection element comprises a strip element comprising plastics, the operating device being embedded in a plastics material of the strip element.

* * * * *